US008146552B2

(12) United States Patent
Seitz et al.

(10) Patent No.: US 8,146,552 B2
(45) Date of Patent: Apr. 3, 2012

(54) COUPLING DEVICE OF A SWITCHABLE CAM FOLLOWER OF A VALVE TRAIN OF AN INTERNAL COMBUSTION ENGINE

(75) Inventors: Joachim Seitz, Reundorf (DE); Joachim Krause, Obermichelbach (DE); Jens Lang, Pressig (DE)

(73) Assignee: Schaeffler Technologies GmbH & Co. KG, Herzogenaurach (DE)

( * ) Notice: Subject to any disclaimer, the term of this patent is extended or adjusted under 35 U.S.C. 154(b) by 410 days.

(21) Appl. No.: 12/485,314

(22) Filed: Jun. 16, 2009

(65) Prior Publication Data

US 2009/0320778 A1 Dec. 31, 2009

(30) Foreign Application Priority Data

Jun. 28, 2008 (DE) ..... 10 2008 030 794

(51) Int. Cl.
*F01L 1/18* (2006.01)

(52) U.S. Cl. ..... 123/90.44; 123/90.39

(58) Field of Classification Search ..... 123/90.39, 123/90.44, 90.45
See application file for complete search history.

(56) References Cited

U.S. PATENT DOCUMENTS 6,966,291 B1 * 11/2005 Fischer et al. ..... 123/90.39
7,201,122 B2 * 4/2007 Schmidt ..... 123/90.16
7,305,951 B2 * 12/2007 Fernandez et al. ..... 123/90.39
7,721,694 B2 * 5/2010 Fernandez et al. ..... 123/90.39
2003/0192497 A1 * 10/2003 Hendriksma et al. ..... 123/90.44
2007/0283915 A1 * 12/2007 Seitz et al. ..... 123/90.39
2009/0078225 A1 * 3/2009 Hendriksma ..... 123/90.39

* cited by examiner

*Primary Examiner* — Thomas Denion
*Assistant Examiner* — Daniel Bernstein
(74) *Attorney, Agent, or Firm* — Volpe and Koenig, P.C.

(57) ABSTRACT

A coupling device (1) of a switchable cam follower (2), in which a borehole (9) extends above a contact (8) for a support element in an outer lever (3) of the cam follower (2), and this borehole has a first section (10) of large diameter that starts from an outer side (11) of a crosspiece (6) on the other end (7) to which connects to a second section (12) of accordingly smaller diameter up to directly before an inner side (13) of the crosspiece (6). A smooth cylindrical coupling slide (14) is guided in a sealing manner through the second section (12), and this coupling slide projects with a sub-region (15) into the first section (10). This sub-region (15) is encompassed by a compression spring (16) that acts, on one end, against an annular end (17) formed between the sections (10, 12) and, on the other end, against a catch element (19) arranged on the lateral surface (18) of the sub-region (15). The first section (10) is closed by a thin-walled plug (20), such that a pressure space (22) for hydraulic medium is located axially between the annular end (17) of the borehole (9) and an inner side (21) of the plug (20), and for a coupled case, the coupling slide (14) can be brought into contact by hydraulic medium that can be guided into the pressure space (22) before its outer end (23) with a sub-region (25) extending on its inner end (24) with a catch surface (26) of a cross region (27) of the inner lever (4) and, for a decoupled case, the coupling slide (14) can be displaced in the direction toward the plug (20) such that it is out of contact from the catch surface (26) for a switched-off/reduced hydraulic medium pressure via the compression spring (16).

10 Claims, 1 Drawing Sheet

COUPLING DEVICE OF A SWITCHABLE CAM FOLLOWER OF A VALVE TRAIN OF AN INTERNAL COMBUSTION ENGINE

CROSS-REFERENCE TO RELATED APPLICATIONS

This application claims the benefit of German patent application no. 10 2008 030 794.7, filed Jun. 28, 2008, which is incorporated herein by reference as if fully set forth.

BACKGROUND

The invention relates to a coupling device of a switchable cam follower of a valve train of an internal combustion engine, wherein this cam follower has an outer lever with an inner lever running between its arms and also, on its bottom side, a single-end contact for a gas-exchange valve, wherein, on this end, the levers move on an axis in a pivoting motion relative to each other, wherein a dome-shaped contact for a support element is inherent in the outer lever on a crosspiece on the other end and at least one of the levers has a cam run-on surface, wherein the coupling device in the outer lever consists of a borehole above the contact, wherein, for a coupled case [large valve stroke], the coupling slide can be brought into contact using a hydraulic medium that can be guided section by section into a pressure space from the contact before its outer end with a sub-region extending close to its inner end with a catch surface of an adjacent cross area of the inner lever, and wherein, for a decoupled case [small or 0 valve stroke], the coupling slide is displaced out of contact from the catch surface for a disconnected/reduced hydraulic medium pressure via the force of a compression spring.

Such coupling devices in cam followers that can be switched off or reversed are adequately known in the technical world. Disadvantages are their relatively complicated construction and also their expensive assembly processes. It has also been determined that in a plurality of the known devices, there is the risk that at least one of the components could become loose in an undesired way during operation.

SUMMARY

The objective of the invention is therefore to create a device of the type noted above in which the mentioned disadvantages are overcome.

This objective is met by a device according to the invention in which the borehole has a first section of large diameter that starts directly from an outer side of the crosspiece on the other end to which connects merely a second section of correspondingly smaller diameter up to directly before an inner side of the crosspiece, wherein a smooth cylindrical coupling slide is guided in a sealing way directly through the second section, wherein this coupling slide projects with a sub-region into the first section and this sub-region is surrounded by at least one compression spring that acts, on one end, against an annular end formed between the sections and, on the other end, against a separate catch element arranged on the lateral surface of the sub-region of the coupling slide and wherein the first section of the borehole is closed close to the outer side of the crosspiece by a thin-walled plug, such that a pressure space for hydraulic medium is located axially between the annular end of the borehole and an inner side of the plug.

In this way, a coupling device is provided in which the mentioned disadvantages are overcome. The coupling device according to the invention is easily constructed and has, in particular, fewer components that can be produced easily with respect to production and assembly. For example, due to its non-stepped construction, the coupling slide has a very simple geometry and can be produced extremely economically in mass production.

The cam follower with the coupling device according to the invention can be constructed as a lever that can be switched off or reversed. In the case of its construction as a stroke switch, the inner lever is pressurized by a large stroke cam. In the case of its construction as a stroke reversing device, the outer lever is contacted by one or two low stroke cams and the inner lever by a large stroke cam.

The plug for sealing the pressure space axially behind the coupling slide is made preferably from a simple steel sheet (its construction from plastic is also conceivably possible). Here, in an extension of the invention, this plug has, on the edges, a collar by which it is seated in the borehole. If necessary, the plug can support additional fixing by a projection, such as a securing ring, axially from the borehole. In addition, it is especially preferred when the plug is used simultaneously as a (slightly flexible) end stop for the coupling slide and thus determines its decoupled position. Alternatively, the plug or a similar component could also be screwed in, welded on, etc.

In an actual example of the invention it is provided to either simply bevel the coupling slide on the pressure-space side or to provide the plug with a projection. Optionally, both measures could be realized simultaneously or it is also conceivable to apply suitable radial passages for the hydraulic medium in some other way on the coupling slide or on the plug. Thus, for the case of a desired displacement of the coupling slide in the coupling direction, from the beginning there is a large projecting hydraulic surface on its outer end. Otherwise it is determined that the coupling slide has good "sensitivity" relative to displacement due to its large hydraulic contact-flow surface on the end.

Simple displacement of the coupling slide in the decoupling direction is realized by the compression spring noted above (also compression spring package). This is supported with its one end on the already existing annular step between the borehole sections. With its other end, it acts against a collar of a thin-walled sheet-metal cylinder that advantageously directly encloses the coupling slide. Here, the sheet-metal cylinder could also be produced in a single deep-drawing process. Its fixing on the lateral surface of the first region of the coupling slide is provided by a projection, such as a securing ring.

An especially simple variant of a stop (path limit) for the coupling slide in its coupling direction is provided when an end of the above sheet-metal cylinder away from the collar contacts the annular step.

The catch surface for the coupling slide on the inner lever can exist as a simple half shell or as a lens-shaped molding, so that, in the coupled case, good enclosure of the coupling slide exists with a low Hertzian stress. Alternatively, the catch surface is provided as a "smooth" crossbar or as a borehole.

Due to the beveled profile of the borehole also listed according to the claims for the coupling slide, the cam follower is not built unnecessarily high and there is sufficient "structural height" at the cross region of the inner lever.

In addition it is provided to let the contact for the support element directly intersect the pressure space section by section. Thus, separate channels could be eliminated. However, it is also possible to connect the contact to the pressure space merely by a short channel.

It is also conceivable and provided to install the coupling device in additional switchable valve-train elements, such as cam followers or rocker arms, cup tappets or roller tappets.

BRIEF DESCRIPTION OF THE DRAWINGS

The invention is explained in greater detail with reference to the drawings.

DETAILED DESCRIPTION OF THE PREFERRED EMBODIMENTS

Figure 1:
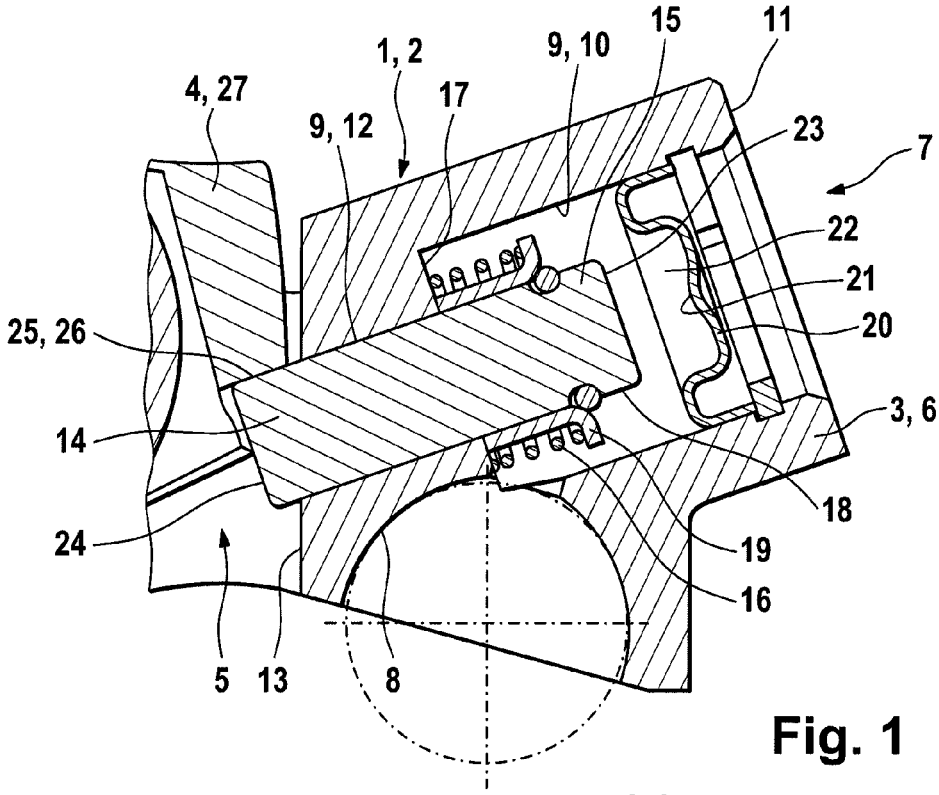
FIGS. 1, 2 show longitudinal section views through a switchable cam follower in the region of its coupling device.

The figures show a switchable cam follower 2 in the region of its coupling device 1. One end 7 is shown on which a dome-shaped contact 8 for a support element runs in an outer lever 3 on a bottom side 5. On the not-shown, opposing end, on the bottom side 5, the cam follower 2 acts on a gas-exchange valve in a lifting sense. An inner lever 4 that is enclosed by arms of the outer lever 3 extends in the region of the latter end on a common axis with the outer lever 3. Both levers 3, 4 can move in a pivoting motion relative to each other.

The outer lever 3 has, on the shown end 7, a crosspiece 6. A stepped borehole 9 extends in this piece. The latter has a first section 10 of large diameter and a second section 12 of accordingly smaller diameter. The section 10 is bored directly from an outer side 11 of the crosspiece 6 and transitions after an annular end 17 into the second section 12. In the latter runs a smooth cylindrical, that is, non-stepped coupling slide 14 that projects with a sub-region 15 into the section 10 in a sealing manner.

A lateral surface 18 of the sub-region 10 is enclosed directly by a catch element that is designated with "15" and that is here constructed as a sheet-metal cylinder and from whose outer end a collar 29 projects. A lateral surface 28 of the catch element 15 is enclosed by a compression spring 16 that acts with one end against the annular end 17 and with another end against the collar 29. As shown, the catch element 15 is fixed in the transition region to the collar 29 on a securing ring 31. It is clear that the compression spring 16 pressurizes the coupling slide 14 into its decoupled position. Its path limit in the coupling direction (see FIG. 1) is given by the contact of its end 32 away from the collar on the annular end 17.

For producing the coupled state disclosed in FIG. 1, in which the coupling slide 14 engages with a sub-region 25 close to its inner end 24 under a complementary catch surface 26 of a cross region 27 of the inner lever 4, hydraulic medium is guided from the support element via the contact 8 into a pressure space 22 before an outer end 23 of the coupling slide 14. The latter is thus displaced against the force of its compression spring 16. The pressure space 22 is shown axially between the annular end 17 and a plug 20 within the first section 10 of the borehole 9.

Figure 2:
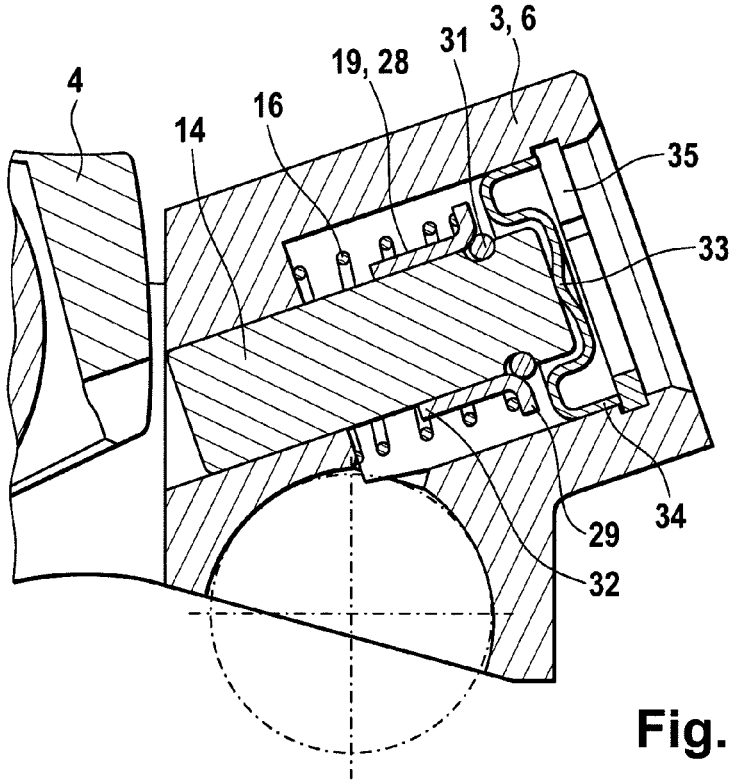

The plug 20 is shown as a thin-walled sheet-metal disk that runs via an edge-side collar 34 in the section 10 of the borehole 9. In the direction toward the outer side 11, the plug 20 is held by a securing ring 35. Here, as shown in FIG. 2, an inner side 21 of the plug 20 is used as a stop for an outer end 23 of the coupling slide 14 in its decoupled position implemented by the force of the compression spring 16. As is to be seen, the inner side 21 of the plug 20 has a central projection 33 on which the outer end 23 of the coupling slide 14 contacts. Thus, an excellent guiding of the hydraulic medium is created before the outer end 23 in the desired coupled case.

List of Reference Symbols

1) Coupling device
2) Cam follower
3) Outer lever
4) Inner lever
5) Bottom side
6) Crosspiece
7) Other end
8) Contact
9) Borehole
10) First section of borehole
11) Outer side of crosspiece
12) Second section of borehole
13) Inner side of crosspiece
14) Coupling slide
15) Sub-region of coupling slide (outer end)
16) Compression spring
17) Annular end
18) Lateral surface
19) Catch element
20) Plug
21) Inner side of plug
22) Pressure space
23) Outer end of coupling slide
24) Inner end of coupling slide
25) Sub-region of coupling slide (inner end)
26) Catch surface
27) Cross region
28) Lateral surface of catch element
29) Collar
31) Securing ring
32) End away from collar
33) Projection
34) Collar of plug
35) Securing ring

The invention claimed is:

1. A switchable cam follower with a coupling device for a valve train of an internal combustion engine, the cam follower comprises an outer lever with an inner lever extending between arms of the outer lever and also, on a bottom side, a single-end contact for a gas-exchange valve, wherein, on the single-end contact, the levers are pivotable about an axis with a pivoting motion relative to each other, a dome-shaped contact for a support element is located in the outer lever on a crosspiece on the other end and at least one of the levers has a cam run-on surface, and the coupling device comprises a borehole in the outer lever located above the dome-shaped contact, wherein the borehole has a first section of large diameter that starts directly from an outer side of the crosspiece on the other end that extends to a second section of accordingly smaller diameter up to directly before an inner side of the crosspiece, wherein a non-stepped, smooth-cylindrical coupling slide is guided in a sealing manner directly through the second section, the coupling slide projects with a sub-region into the first section, the sub-region is encompassed by at least one compression spring that acts, on one end, against an annular end formed between the first and second sections and, on the other end, against a separate catch element arranged on a lateral surface of the sub-region of the coupling slide, wherein the catch element is a thin-walled sheet-metal cylinder that has, on a pressure space side, a radially outwardly bent collar against which another end of the compression spring acts, wherein the first section of the borehole is closed close to the outer side of the crosspiece by a thin-walled plug, such that a pressure space for hydraulic medium is provided axially between the annular end of the borehole and an inner side of the plug, and, for a coupled case adapted to provide a large valve stroke, the coupling slide can be brought into contact by hydraulic medium that can be guided section by section into the pressure space from the contact before the outer end with a sub-section running close to an inner end with a catch surface of an adjacent cross region of the inner lever and wherein, for a decoupled case to provide a small or 0 valve stroke, the coupling slide is displaceable in a direction toward the plug such that it is out of contact from the catch surface for a switched-off/reduced hydraulic medium pressure by a force of the compression spring.

2. The switchable cam follower with a coupling device according to claim 1, wherein the catch element is fixed in the axial direction in a transition region to the collar on a securing ring or snap ring mounted on the lateral surface of the coupling slide.

3. The switchable cam follower with a coupling device according to claim 1, wherein, through contact of one end of the catch element away from the collar, a coupled position of the coupling slide is determined on the annular end of the borehole.

4. The switchable cam follower with a coupling device according to claim 1, wherein a decoupled position of the coupling slide is determined by contact of an outer end of the coupling slide on an inner side of the plug.

5. The switchable cam follower with a coupling device according to claim 4, wherein either the outer end of the coupling slide is beveled or wherein the inner side of the plug is provided with at least one projection projecting in a direction toward the coupling slide or wherein both the outer end of the coupling slide is beveled and the inner side of the plug is provided with the at least one projection.

6. The switchable cam follower with a coupling device according to claim 5, wherein the plug comprises a thin-walled sheet-metal disk that is fixed in the borehole via a collar that is angled on an edge thereof.

7. The switchable cam follower with a coupling device according to claim 6, wherein the plug is additionally secured in the borehole by a securing ring or snap ring fixed in the borehole.

8. The switchable cam follower with a coupling device according to claim 1, wherein the catch surface on the inner lever comprises a borehole, half shell, or a beam.

9. The switchable cam follower with a coupling device according to claim 1, wherein the borehole viewed from the outer side of the crosspiece and in cross section extends downward at an angle.

10. The switchable cam follower with a coupling device according to claim 1, wherein for pressurization with hydraulic medium, the pressure space directly intersects a contact for the support.

* * * * *